US011402770B2

(12) United States Patent
Boettcher et al.

(10) Patent No.: US 11,402,770 B2
(45) Date of Patent: Aug. 2, 2022

(54) SEAL FOR AN ELECTROPHOTOGRAPHIC IMAGE FORMING DEVICE

(71) Applicant: LEXMARK INTERNATIONAL, INC., Lexington, KY (US)

(72) Inventors: Brian Lester Boettcher, Versailles, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/182,771

(22) Filed: Feb. 23, 2021

(65) Prior Publication Data

US 2021/0181656 A1 Jun. 17, 2021

Related U.S. Application Data

(62) Division of application No. 16/737,480, filed on Jan. 8, 2020, now Pat. No. 10,962,905.

(60) Provisional application No. 62/923,736, filed on Oct. 21, 2019.

(51) Int. Cl.
*G03G 15/08* (2006.01)

(52) U.S. Cl.
CPC ..... *G03G 15/0898* (2013.01); *G03G 15/0817* (2013.01); *G03G 15/0865* (2013.01); *G03G 15/0881* (2013.01); *G03G 15/0894* (2013.01); *G03G 2215/00991* (2013.01); *G03G 2215/0687* (2013.01); *G03G 2221/1648* (2013.01)

(58) Field of Classification Search
CPC ..... G03G 15/0817; G03G 15/0865; G03G 15/0881; G03G 15/0894; G03G 15/0898; G03G 2215/00991; G03G 2215/0687; G03G 2221/1648
See application file for complete search history.

(56) References Cited

U.S. PATENT DOCUMENTS

2013/0322927 A1* 12/2013 Matsumoto ..... G03G 15/0879 399/258
2014/0029973 A1* 1/2014 Terazawa ..... G03G 15/0881 399/106
2017/0090348 A1* 3/2017 Eto ..... G03G 15/0889

* cited by examiner

*Primary Examiner* — Joseph S Wong
(74) *Attorney, Agent, or Firm* — Justin M. Tromp

(57) ABSTRACT

A toner sealing system is described including a seal having first and second alignment features. The seal is selectably installable on one of a first toner container of a first type and a second toner container of a second type. The first alignment feature is matable with a first corresponding alignment feature on the first toner container when the seal is installed on the first toner container for aligning the seal to the first toner container. The second alignment feature is matable with a second corresponding alignment feature on the second toner container when the seal is installed on the second toner container for aligning the seal to the second toner container. Embodiments include those wherein the first alignment feature does not align the seal to the second toner container, and the second alignment feature does not align the seal to the first toner container.

5 Claims, 11 Drawing Sheets

SEAL FOR AN ELECTROPHOTOGRAPHIC IMAGE FORMING DEVICE

CROSS REFERENCES TO RELATED APPLICATIONS

This application is a divisional application of U.S. patent application Ser. No. 16/737,480, filed Jan. 8, 2020, entitled "Seal for an Electrophotographic Image Forming Device," which claims priority to U.S. Provisional Patent Application Ser. No. 62/923,736, filed Oct. 21, 2019, entitled "Seal for an Electrophotographic Image Forming Device," the contents of which are hereby incorporated by reference in their entirety.

BACKGROUND

1. Field of the Disclosure

The present disclosure relates generally to image forming devices and more particularly to a seal for an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units, such as a toner cartridge, which may include various components for handling toner. Seals help prevent toner leakage in the replaceable units. For example, toner leakage may occur from gaps between one or more toner handling components of the replaceable unit and a housing of the replaceable unit. Seals may be provided to effectively close these gaps to prevent toner leakage. Proper alignment of the seals is important in order to prevent toner leakage. Misalignment of a seal may create gaps forming a leak path for toner to escape the replaceable unit. Accordingly, improved alignment and positioning of toner seals is desired.

SUMMARY

A toner seal according to one example embodiment includes a body having a first face and a second face opposite the first face. The body has an edge defined by a thickness of the body and forming a boundary of each of the first and second faces. A slot is formed in a first end of the edge of the body for matably receiving a corresponding projection when the seal is installed on a toner container of a first type for aligning the seal to the toner container of the first type. A tab projects from a second end of the edge of the body that is opposite the first end of the edge of the body for matably engaging a corresponding slot when the seal is installed on a toner container of a second type for aligning the seal to the toner container of the second type.

A toner container according to one example embodiment includes a housing including a main body that has a reservoir for storing toner. A wall of the main body includes an inner surface that forms a boundary of the reservoir. The wall of the main body includes an opening therethrough. A seal has a first face and a second face opposite the first face. The first face of the seal is adhered to a surface of the housing that faces toward an outer surface of the wall of the main body. The second face of the seal is pressed against a portion of the outer surface of the wall of the main body surrounding the opening. The second face of the seal covers the opening to block toner from escaping the reservoir through the opening.

A system according to one example embodiment includes a first toner container of a first type and a second toner container of a second type different from the first type. A seal has a first alignment feature and a second alignment feature. The seal is selectably installable on one of the first toner container for preventing toner leakage from the first toner container and the second toner container for preventing toner leakage from the second toner container. The first alignment feature is matable with a first corresponding alignment feature on the first toner container when the seal is installed on the first toner container for aligning the seal to the first toner container. The second alignment feature is matable with a second corresponding alignment feature on the second toner container when the seal is installed on the second toner container for aligning the seal to the second toner container. The first alignment feature does not align the seal to the second toner container when the seal is installed on the second toner container.

A method for sealing toner according to one example embodiment includes selectably installing a toner seal on one of a first toner container of a first type and a second toner container of a second type different from the first type. Installation of the toner seal on the first toner container includes aligning a first alignment feature of the toner seal with a first corresponding alignment feature of the first toner container to align the toner seal to the first toner container. Installation of the toner seal on the second toner container includes aligning a second alignment feature of the toner seal with a second corresponding alignment feature of the second toner container to align the toner seal to the second toner container without the first alignment feature aligning the toner seal to the second toner container.

A method for sealing toner according to another example embodiment includes installing a first toner seal on a first toner container of a first type including aligning a first to alignment feature of the first toner seal with a first corresponding alignment feature of the first toner container to align the first toner seal to the first toner container. A second toner seal that is substantially identical to the first toner seal is installed on a second toner container of a second type that is different from the first type including aligning a second alignment feature of the second toner seal that is different from the first alignment feature of the first toner seal with a second corresponding alignment feature of the second toner container to align the second toner seal to the second toner container without a first alignment feature of the second toner seal that is substantially identical to the first alignment feature of the first toner seal aligning the second toner seal to the second toner container.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
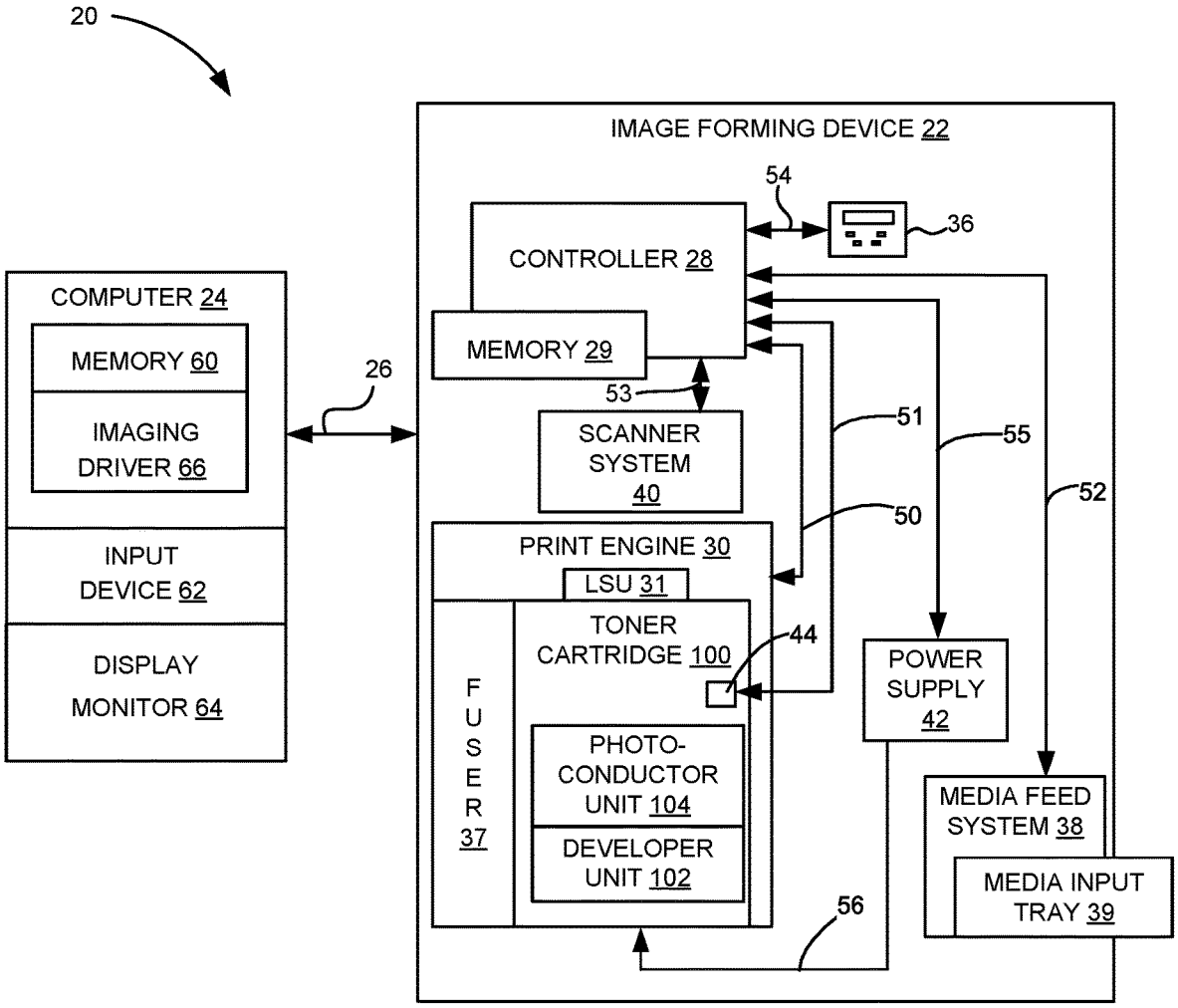
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24, Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AK)) device) that includes a controller 28, a print engine 30, a laser scan unit (LSU) 31, a toner cartridge 100, a user interface 36, a media teed system 38, a media input tray 39, a scanner system 40 and a power supply 42, Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational interlocks, operating parameters and usage information related to toner cartridge 100. Processing circuitry 44 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24, One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24, Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100 and a fuser 37, all mounted within image forming device 22. Toner cartridge 100 is removably mounted in image forming device 22. Power supply 42 provides an electrical voltage to various components of toner cartridge 100 via an electrical path 56. Toner cartridge 100 includes a developer unit 102 that houses a toner reservoir and a toner development system. In the example embodiment illustrated, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color (e.g., black, cyan, yellow and magenta) to permit color printing.

Figure 2:
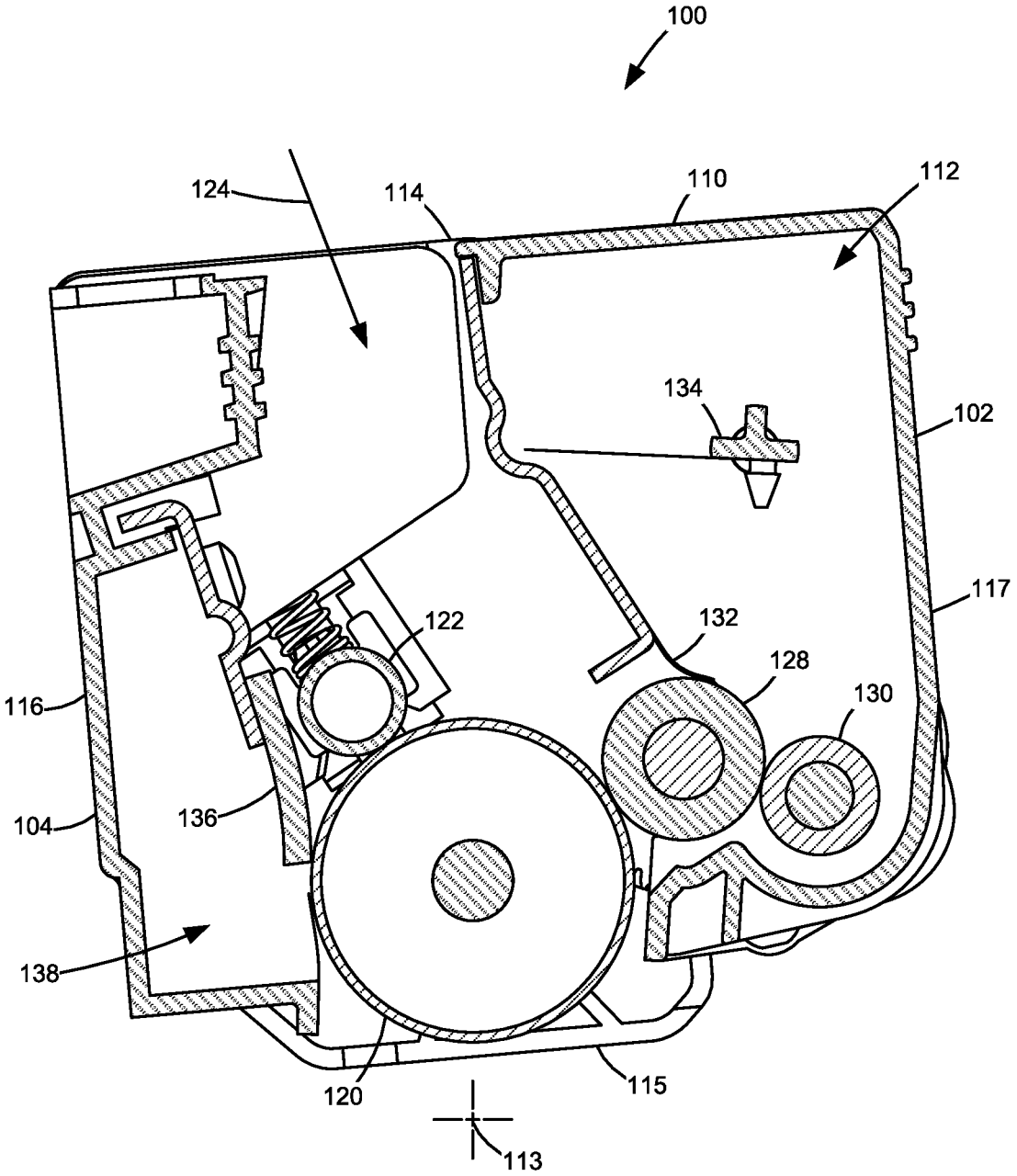
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. Housing 110 generally includes various elements that form the overall body and support structure of toner cartridge 100 including, for example, one or more main body portions, end caps, lids, gear plates, etc. In the example embodiment illustrated, housing 110 extends along a longitudinal dimension 113 and includes a top 114, a bottom 115, a side 116 and a side 117 that extend between longitudinal ends 118, 119 (FIGS. 3 and 4) of housing 110. In this embodiment, developer unit 102 is positioned along side 117 of housing 110, and photoconductor unit 104 is positioned along side 116 of housing 110.

The electrophotographic printing process is well known in the art and, therefore, is described briefly herein. During a print operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit 126 (FIG. 4) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 122 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

The toned image is then transferred from photoconductive drum 120 to the print media (e.g., paper) either directly by photoconductive drum 120 or indirectly by an intermediate transfer member. In the example embodiment illustrated, the surface of photoconductive drum 120 is exposed from housing 110 along the bottom 115 of housing 110 where the toned image transfers from photoconductive drum 120 to the print media or intermediate transfer member. Fuser 37 (FIG. 1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member. Waste toner from cleaner blade 136 may be held in a waste toner reservoir 38 in photoconductor unit 104 as illustrated or moved to a separate waste toner container. The cleaned surface of photoconductive drum 120 is then ready to be charged again and exposed to laser light source 124 to continue the printing cycle.

Figure 3:
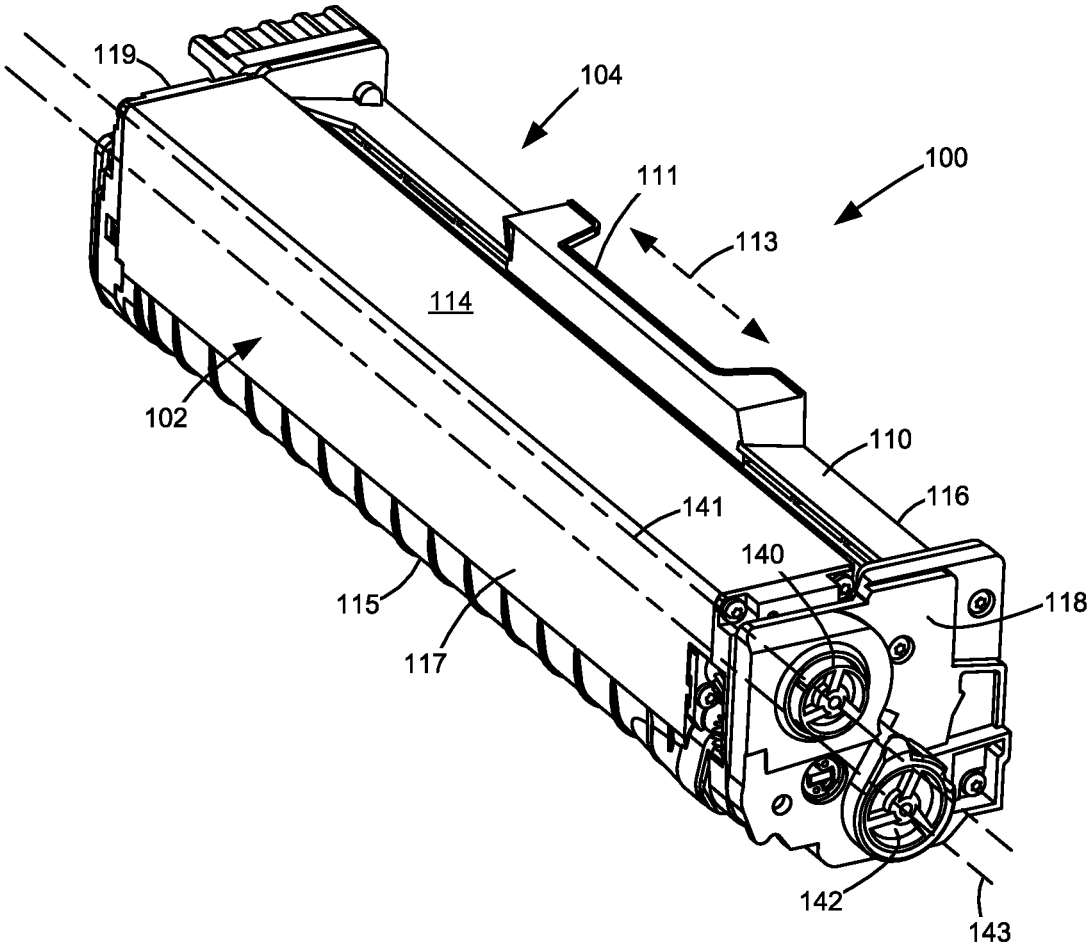
FIGS. 3 and 4 are perspective views of the toner cartridge according to a first example embodiment.
Figure 4:
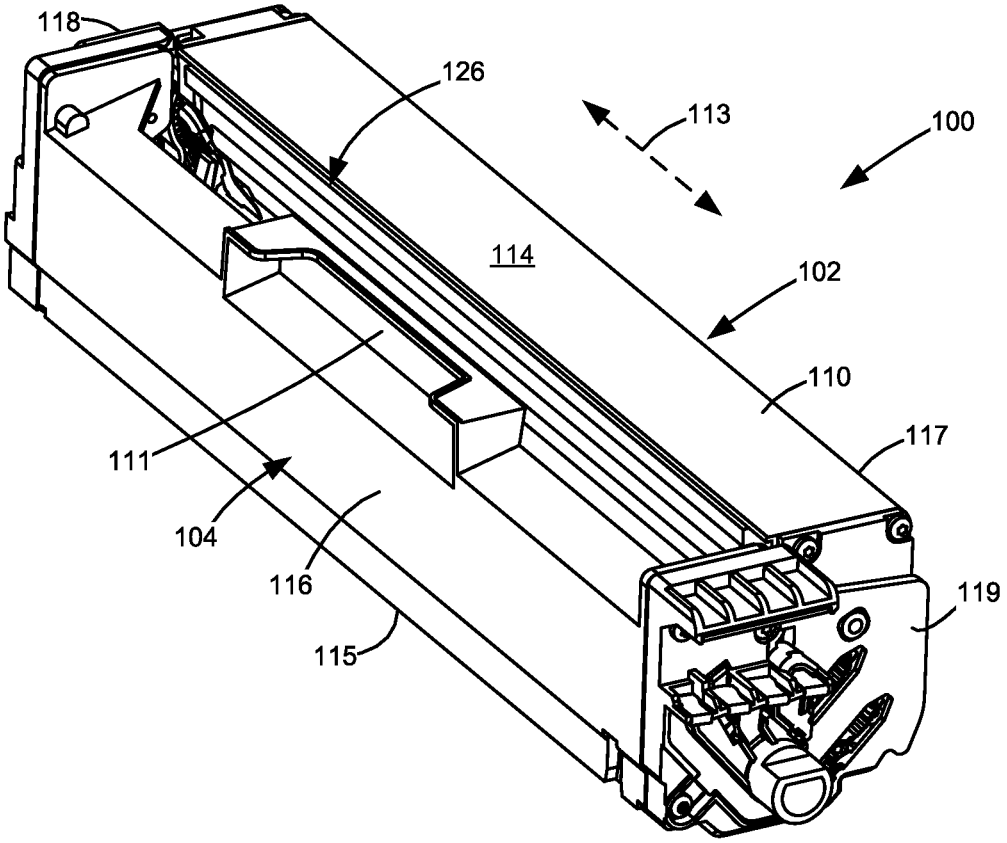
Figure 5:
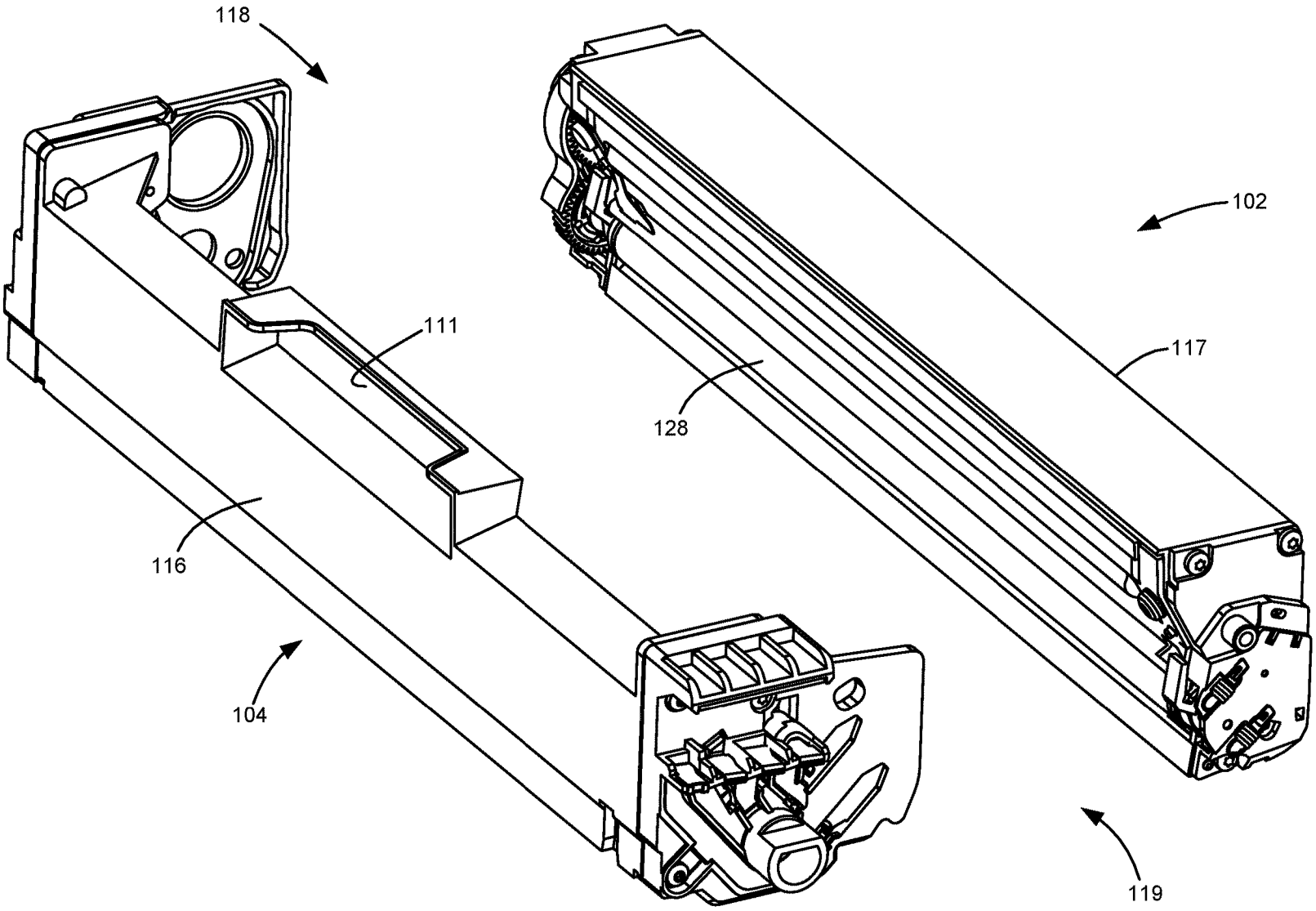
FIG. 5 is an exploded view of the toner cartridge shown in FIGS. 3 and 4 showing a developer unit and a photoconductor unit of the toner cartridge according to one example embodiment.

FIGS. 3-5 show the exterior of toner cartridge 100 according to one example embodiment. As shown, in this embodiment, developer unit 102 is positioned at side 117 of housing 110, and photoconductor unit 104 is positioned at side 116 of housing 110. FIG. 5 shows developer unit 102 separated from photoconductor unit 104 with developer roll 128 exposed on developer unit 102 for mating with photoconductive drum 120. In the example embodiment illustrated, toner cartridge 100 includes a handle 111 positioned along side 116 and/or top 114 of housing 110 to assist the user with handling toner cartridge 100.

With reference to FIG. 3, in the example embodiment illustrated, a pair of drive couplers 140, 142 are exposed on an outer portion of housing 110 in position to receive rotational force from a corresponding drive system in image forming device 22 when toner cartridge 100 is installed in image forming device 22 to drive rotatable components of developer unit 102 and photoconductive drum 120, respectively. The drive system in image forming device 22 includes one or more drive motors and a drive transmission from the drive motors) to a pair of drive couplers that mate with drive couplers 140, 142 of toner cartridge 100 when toner cartridge 100 is installed in image forming device 22. In the example embodiment illustrated, drive couplers 140, 142 are each exposed on end 118 of housing 110, Each drive coupler 140, 142 includes a rotational axis 141, 143. Each drive coupler 140, 142 includes a force receiving portion that mates with and receives rotational motion from the corresponding drive couplers in image forming device 22. Drive coupler 140 is operatively connected (either directly or indirectly through one or more intermediate gears) to rotatable components of developer unit 102 including, for example, developer roll 128, toner adder roll 130 and toner agitator 134, to rotate developer roll 128, toner adder roll 130 and toner agitator 134 upon receiving rotational force from the corresponding drive system in image forming device 22. Drive coupler 142 is operatively connected (either directly, as in the embodiment illustrated, or indirectly through one or more intermediate gears) to photoconductive drum 120 to rotate photoconductive drum 120 upon receiving rotational force from the corresponding drive system in image forming device 22. In some embodiments, charge roll 122 is driven by friction contact between the surfaces of charge roll 122 and photoconductive drum 120. In other embodiments, charge roll 122 is connected to drive coupler 142 by one or more gears.

Figure 6:
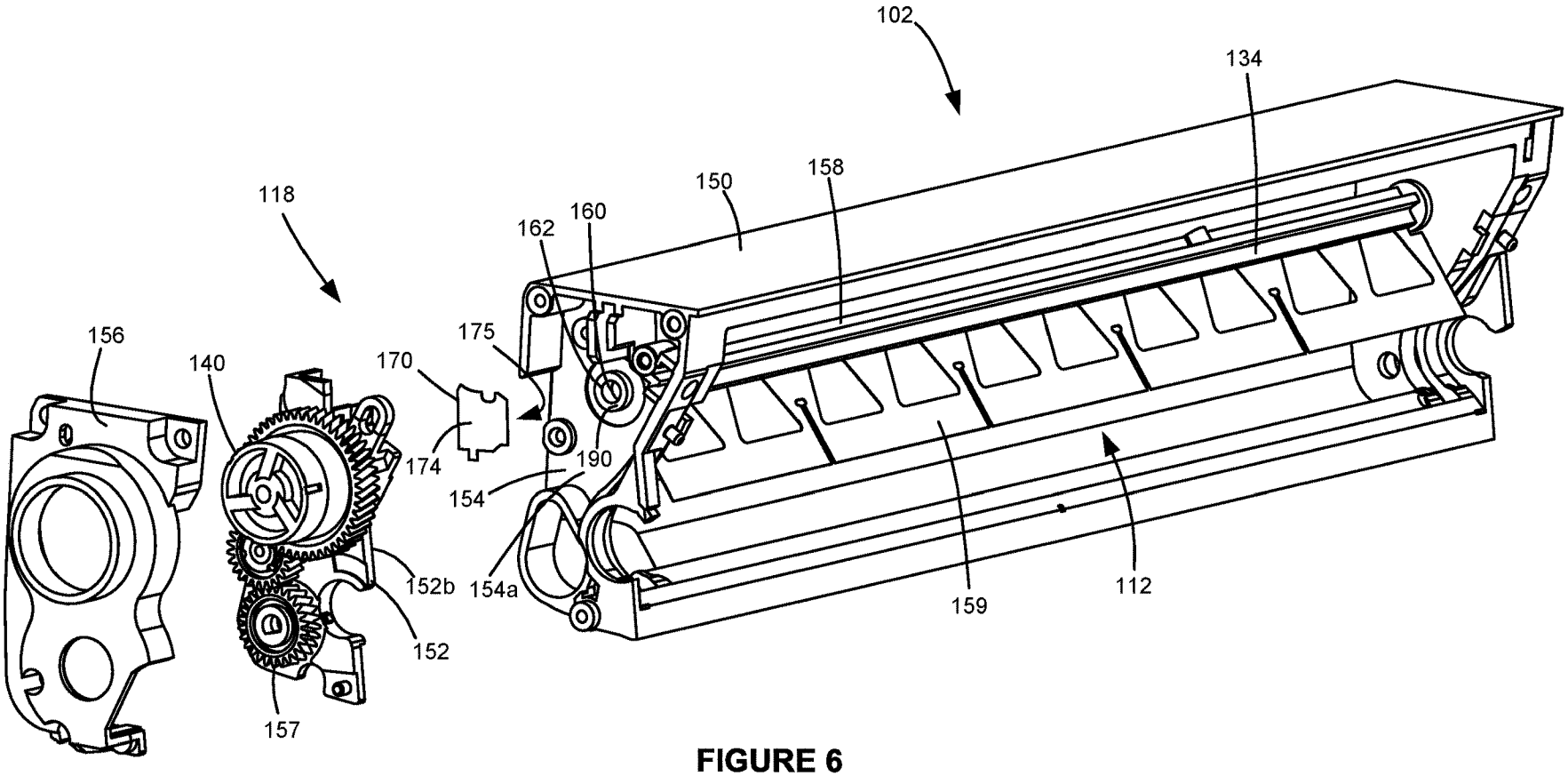
FIG. 6 is an exploded view showing a portion of the developer unit of the toner cartridge shown in FIGS. 3-5 according to one example embodiment.

With reference to FIG. 6, a portion of developer unit 102 is shown according to one example embodiment. In this embodiment, housing 110 includes a main body 150 of developer unit 102 and a gear plate 152 positioned against an outer surface 154*a* of an end wall 154 of main body 150 at end 118 of housing 110. In this embodiment, housing 110 also includes an end cap 156 mounted to gear plate 152 and/or main body 150 at end 118 of housing 110. End cap 156 covers and helps retain one or more gears 157 positioned between end cap 156 and gear plate 152.

FIG. 6 shows developer unit 102 with various components (e.g., developer roll 128, toner adder roll 130 and doctor blade 132) omitted in order to show toner reservoir 112 and toner agitator 134 therein. Toner agitator 134 includes a rotatable shaft 158 and one or more projections or extensions 159 from shaft 158 that agitate and move toner in reservoir 112 when shaft 158 rotates. A bearing 160 formed in end wall 154 rotatably supports shaft 158 near end 118 of housing 110. In the embodiment illustrated, bearing 160 includes a hole 162 through end wall 154, which, in this embodiment, is necessitated by molding limitations related to the manufacture of main body 150.

A seal 170 is positioned against outer surface 154*a* of end wall 154 and covers hole 162 in order to prevent toner from escaping reservoir 112 through hole 162. In the embodiment illustrated, seal 170 is positioned between an inner surface 152*b* of gear plate 152 and outer surface 154*a* of end wall 154.

Figure 7A:
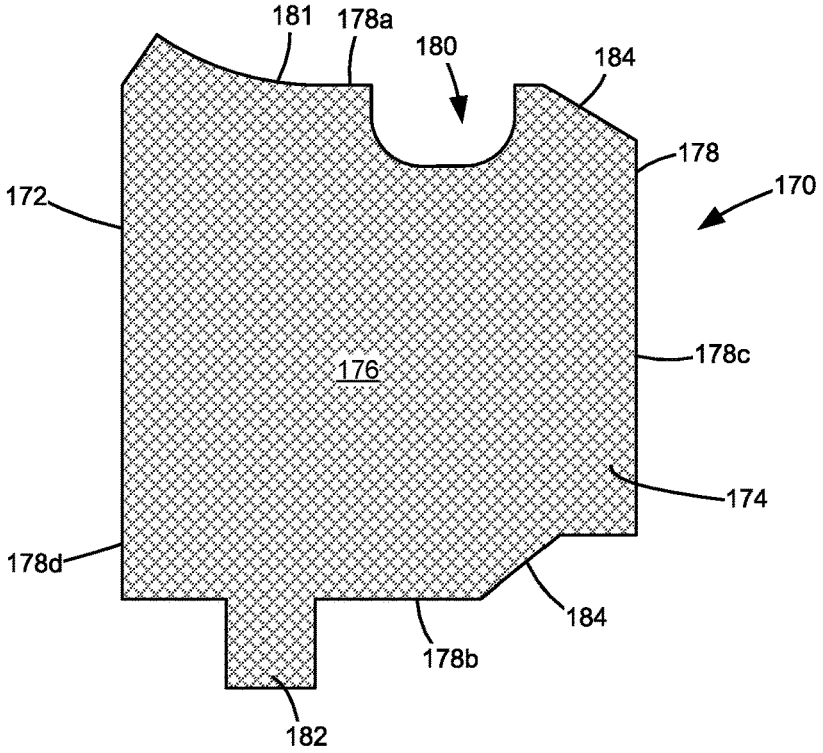
FIGS. 7A and 7B are elevation views of opposite faces of a seal according to one example embodiment.
Figure 7B:
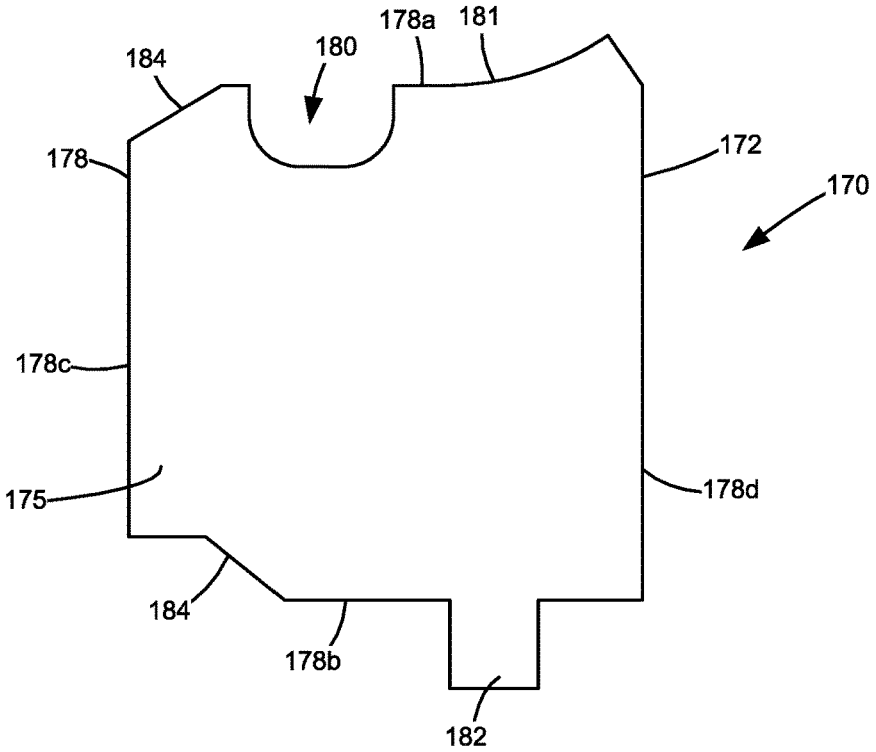

FIGS. 7A and 7B show seal 170 in greater detail according to one example embodiment. Seal 170 includes a body 172. In some embodiments, body 172 is composed of a film material, such as, for example, a polyurethane or a polyester (e.g., MYLAR® available from DuPont Teijin Films, Chester, Va., USA). In other embodiments, body 172 is composed of, for example, a relatively thin foam, felt or other material suitable for sealing by indentation, such as a thermoformed plastic material. Body 172 includes a first face 174 and a second face 175 opposite first face 174. In the embodiment illustrated, an adhesive 176 is positioned on face 174 (but not on face 175) as depicted by the cross-hatching in FIG. 7A. Body 172 includes a contoured edge 178 that is defined by a thickness of body 172 and that forms the boundaries of faces 174, 175. Contoured edge 178 includes one or more alignment features that help an assembly technician align seal 170 during installation of seal 170 onto housing 110 as discussed in greater detail below. For example, in the embodiment illustrated, a U-shaped slot 180 is formed along a first end 178*a* of edge 178, and a tab 182 projects outward away from a second end 178*b* of edge 178, opposite first end 178*a*. In the embodiment illustrated, slot 180 is positioned closer to a third end 178*c* of edge 178 than to a fourth end 178*d* of edge 178, and tab 182 is positioned closer to fourth end 178*d* of edge 178 than to third end 178*c* of edge 178. In this embodiment, a concave segment 181 is formed along first end 178*a* of edge 178, next to slot 180. In the embodiment illustrated, concave segment 181 is positioned closer to fourth end 178*d* of edge 178 than to third end 178*c* of edge 178.

As discussed in greater detail below, slot 180 is configured to matably receive a to corresponding projection when seal 170 is installed on a toner cartridge of a first type for aligning seal 170 to the toner cartridge of the first type, and tab 182 is configured to matably fit into a corresponding slot when seal 170 is installed on a toner cartridge of a second type for aligning seal 170 to the toner cartridge of the second type. Similarly, concave segment 181 is configured to matably receive a corresponding convex surface when seal 170 is installed on the toner cartridge of the first type for aligning seal 170 to the toner cartridge of the first type. Body 172 may also include one or more cutouts 184 formed along edge 178 to avoid interference with one or more structures when seal 170 is installed on either the toner cartridge of the first type or the toner cartridge of the second type.

Figure 8:
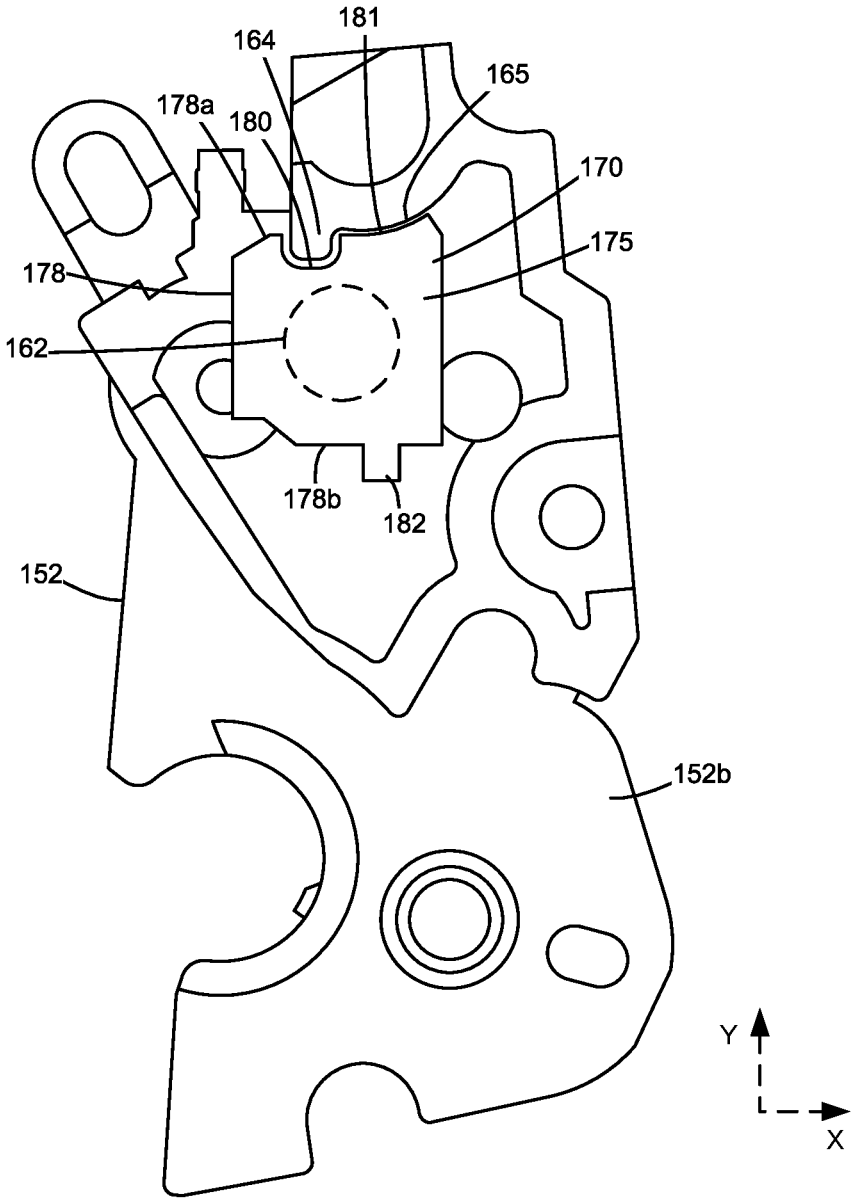
FIG. 8 is an elevation view of an inner surface of a gear plate of the developer unit shown in FIG. 6 having the seal adhered thereto according to one example embodiment.

FIG. 8 shows the attachment of seal 170 to inner surface 152*b* of gear plate 152 of toner cartridge 100 according to one example embodiment, Face 174 of seal 170 is pressed against and adhered to inner surface 152*b* of gear plate 152 by adhesive 176. Face 175 of seal 170 faces away from inner surface 152*b* of gear plate 152, toward outer surface 154*a* of end wall 154 and toner reservoir 112. Slot 180 on end 178*a* of edge 178 matably receives a corresponding projection 164 on inner surface 152*b* of gear plate 152. By aligning slot 180 on seal 170 with projection 164 on gear plate 152, these features help an assembly technician properly position seal 170 relative to gear plate 152 along a side-to-side dimension (x) of housing 110 and a vertical dimension (y) of housing 110 in order to ensure that seal 170 covers hole 162 when gear plate 152 is attached to main body 150. The location of hole 162 on end wall 154 is shown in dashed lines in FIG. 8 to illustrate the positioning of seal 170 relative to hole 162 when seal 170 is positioned on gear plate 152 and gear plate 152 is attached to main body 150. In the embodiment illustrated, concave segment 181 matably receives a corresponding convex surface 165 on inner surface 1526 of gear plate 152. The engagement between concave segment 181 on seal 170 and convex surface 165 on gear plate 152 further aids an assembly technician with positioning seal 170 relative to gear plate 152.

With reference back to FIG. 6, outer surface 154*a* of end wall 154 includes a ring 190 that surrounds hole 162 and that protrudes outward toward inner surface 152*b* of gear plate 152, In the example embodiment illustrated, when gear plate 152 is attached to main body 150 with seal 170 adhered to gear plate 152, seal 170 is pressed against ring 190. Seal 170 tends to conform to ring 190 on end wall 154 when pressed against ring 190 by gear plate 152 allowing seal 170 to act as a gasket between inner surface 1526 of gear plate 152 and outer surface 154*a* of end wall 154 in order to reliably seal hole 162.

Figure 9:
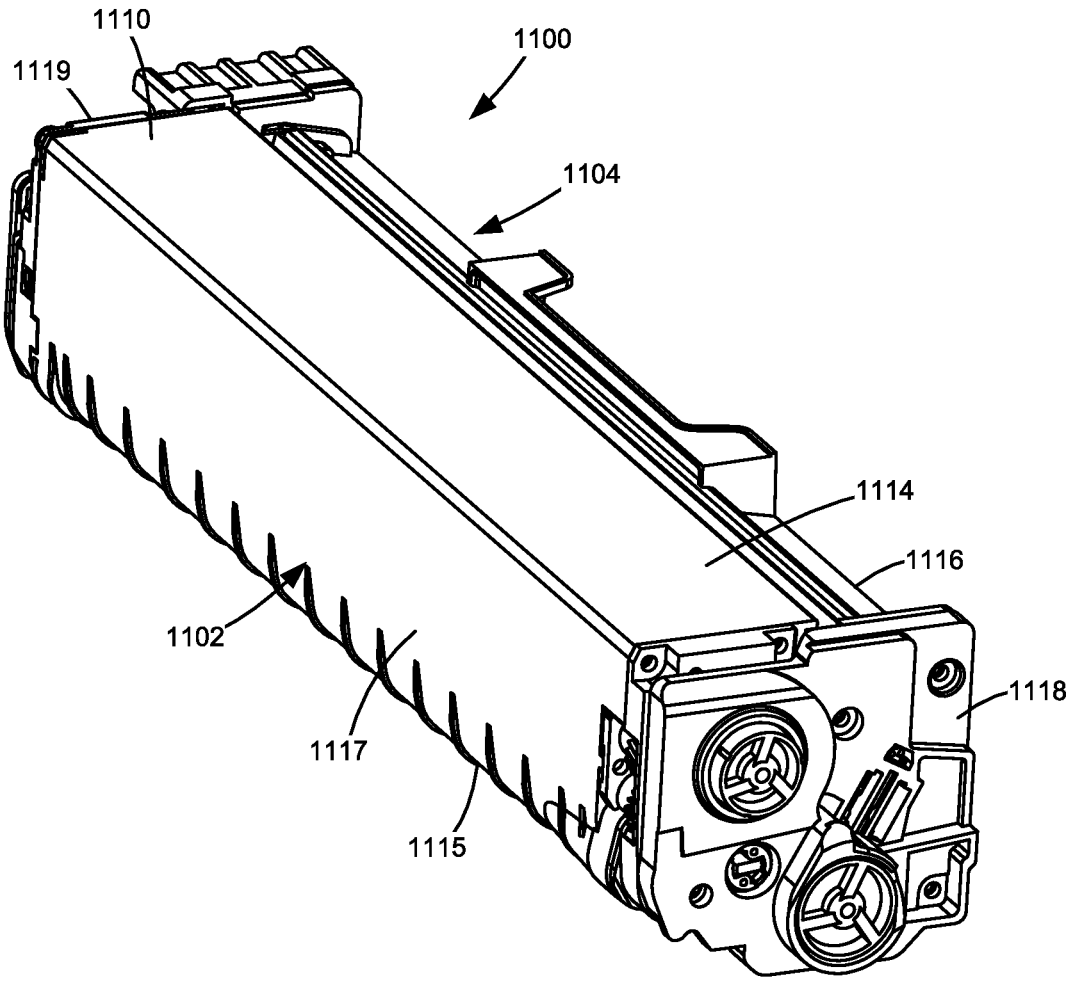
FIG. 9 is a perspective view of a toner cartridge according to a second example embodiment.

FIG. 9 shows a toner cartridge 1100 according to another example embodiment. Like toner cartridge 100 discussed above, toner cartridge 1100 includes a developer unit 1102 and a photoconductor unit 1104. Toner cartridge 1100 includes a housing 1110 having a top 1114, a bottom 1115, a side 1116 and a side 1117 that extend between longitudinal ends 1118, 1119 of housing 1110.

In the example embodiment illustrated, toner cartridge 1100 includes seal 170 discussed above to help prevent toner leakage such that a common seal 170 is used across multiple toner cartridge designs. This eliminates the need for a unique seal for each toner cartridge design providing improved manufacturing efficiency and reduced cost. Toner cartridge 1100 may, for example, include a larger housing 1100 in comparison with housing 110 of toner cartridge 100, including a larger toner reservoir 1112 than toner reservoir 112 of toner cartridge 100, allowing toner cartridge 1100 to accommodate more toner than toner cartridge 100, which may be desired in workspaces with heavier printing volumes. Toner cartridge 1100 may be configured for use in the same type of image forming device as toner cartridge 100, or toner cartridges 100 and 1100 may be configured for use in different types of image forming devices, e.g., in different families or models of image forming devices.

Figure 10:
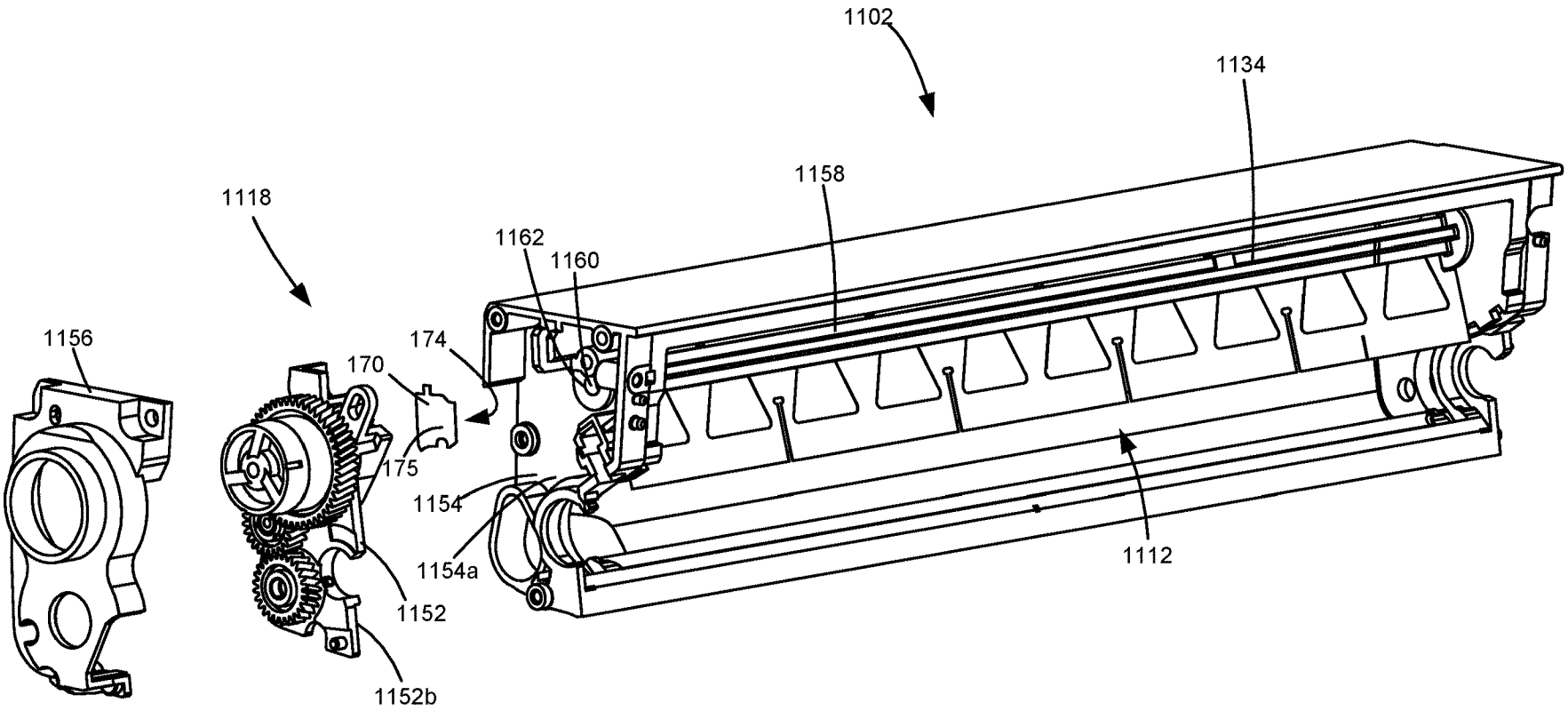
FIG. 10 is an exploded view showing a portion of a developer unit of the toner cartridge shown in FIG. 9 according to one example embodiment.

With reference to FIG. 10, a portion of developer unit 1102 of toner cartridge 1100 is shown according to one example embodiment. In this embodiment, housing 1110 includes a main body 1150 of developer unit 1102 and a gear plate 1152 positioned against an outer surface 1154*a* of an end wall 1154 of main body 1150 at end 1118 of housing 1110. Housing 1110 may also include an end cap 1156 mounted to gear plate 1152 and/or main body 1150 at end 1118 of housing 1110 as discussed above with respect to toner cartridge 100.

Like FIG. 6 discussed above, FIG. 10 shows developer unit 1102 with various components omitted in order to show toner reservoir 1112 and a toner agitator 1134 therein. A bearing 1160 formed in end wall 1154 rotatably supports a shaft 1158 of toner agitator 1134 as discussed above. As with toner cartridge 100, bearing 1160 includes a hole 1162 through end wall 1154. In this embodiment, seal 170 is adhered to outer surface 1154*a* of end wall 1154 by adhesive 176 on face 174 in position to cover hole 1162 in order to prevent toner from escaping reservoir 1112 through hole 1162.

Figure 11:
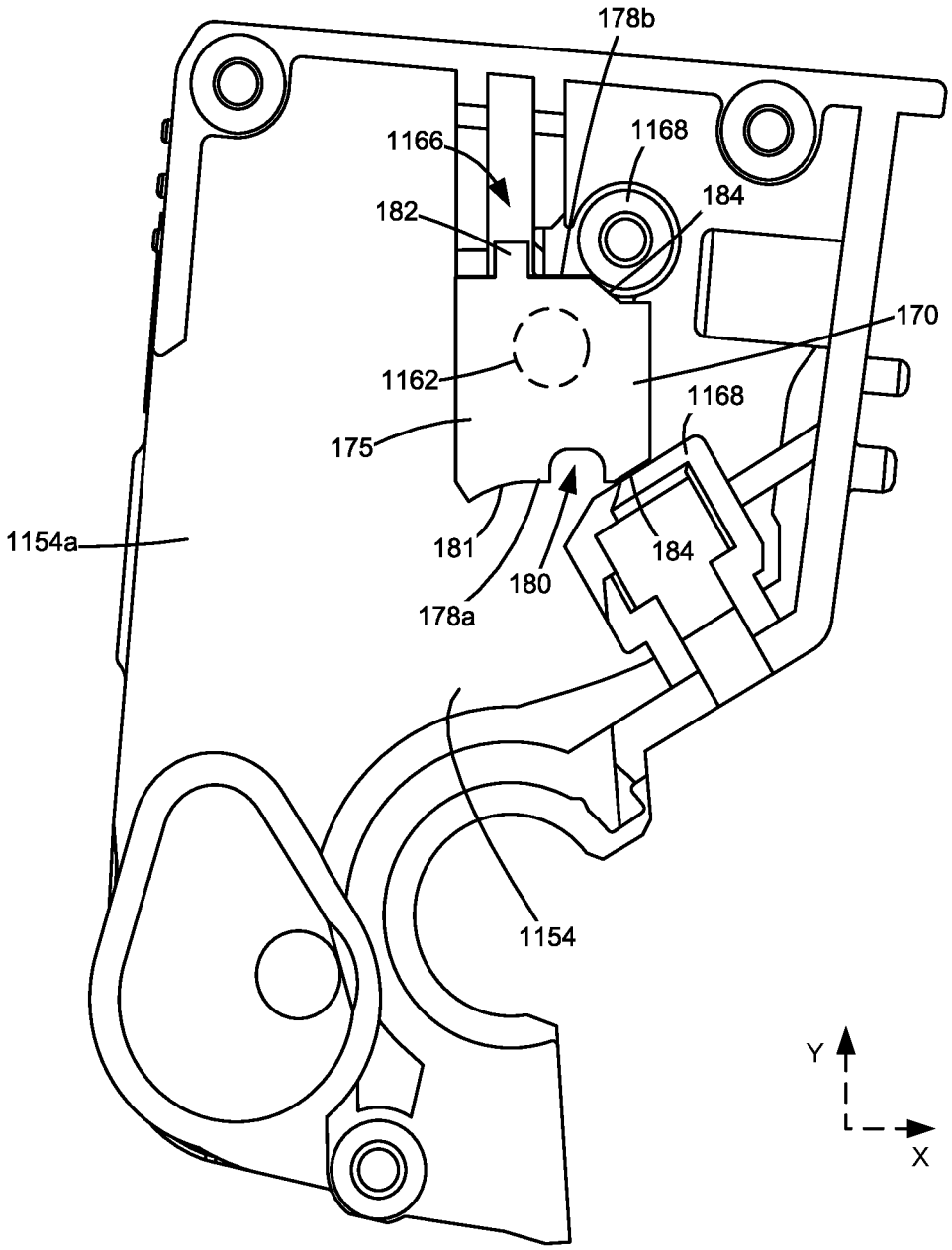
FIG. 11 is an elevation view of an outer surface of an end wall of the developer unit shown in FIG. 10 having the seal shown in FIGS. 7A and 7B adhered thereto according to one example embodiment.

FIG. 11 shows the attachment of seal 170 to outer surface 1154*a* of end wall 1154 of toner cartridge 1100 in greater detail according to one example embodiment. Face 174 of seal 170 is pressed against and adhered to outer surface 1154*a* of end wall 1154 by adhesive 176. Face 175 of seal 170 faces toward inner surface 1152*b* of gear plate 1152, away from outer surface 1154*a* of end wall 1154 and toner reservoir 1112. Tab 182 on end 178*b* of edge 178 matably fits into a corresponding slot 1166 on outer surface 1154*a* of end wall 1154. By aligning tab 182 on seal 170 with slot 1166 on end wall 1154, these features help an assembly technician properly position seal 170 relative to end wall 1154 along a side-to-side dimension (x) of housing 1110 and a vertical dimension (y) of housing 1110 in order to ensure that seal 170 covers hole 1162 as discussed above. The location of hole 1162 on end wall 1154 is shown in dashed lines in FIG. 11 to illustrate the positioning of seal 170 relative to hole 1162. In this embodiment, cutouts 184 of seal 170 are positioned to accommodate and provide clearance for corresponding features 1168 on outer surface 1154*a* of end wall 1154.

In some embodiments, a first set of one or more alignment features of seal 170 align seal 170 when seal 170 is installed on a toner cartridge of a first type, but the first set of alignment features does not provide alignment of seal 170 when seal is installed on a toner cartridge of a second type. Similarly, a second set of one or more alignment features of seal 170 align seal 170 when seal 170 is installed on the toner cartridge of the second type, but the second set of alignment features does not provide alignment of seal 170 when seal is installed on the toner cartridge of the first type. For example, in the embodiments illustrated, slot 180 and concave surface 181 align seal 170 to inner surface 152*b* of gear plate 152 when seal 170 is installed on toner cartridge 100 as shown in FIG. 8, but tab 182 does not provide alignment of seal 170 when seal 170 is installed on toner cartridge 100. Conversely, tab 182 aligns seal 170 to outer surface 1154*a* of end wall 1154 when seal 170 is installed on toner cartridge 1100 as shown in FIG. 11, but slot 180 and concave surface 181 do not provide alignment of seal 170 when seal 170 is installed on toner cartridge 1100.

While the example embodiment illustrated includes a seal 170 composed of a thin film body 172 having alignment features at opposite ends 178*a*, 178*b* of an edge 178 of seal 170, those skilled in the art will appreciate that the seal may take other suitable shapes and constructions as desired. For example, the alignment features of the seal may be positioned to elsewhere on the seal and may take other configurations, e.g., other male and/or female configurations. Further, while the example embodiment illustrated includes a seal 170 covering a hole 162, 1162 on the main body of a developer unit, it will be appreciated that the seal may be positioned elsewhere in order to seal toner in other locations, e.g., on other portions of developer unit 102, 1102, on photoconductor unit 104, 1104, or on waste toner reservoir 138, as desired.

Although the example embodiment illustrated includes a single replaceable unit in the form of toner cartridge 100 for each toner color, it will be appreciated that the replaceable unit(s) of the image forming device may employ any suitable configuration as desired. For example, in another embodiment, the main toner supply for the image forming device is provided in a first replaceable unit, and the developer unit and photoconductor unit are provided in a second replaceable unit. Other configurations may be used as desired.

Further, it will be appreciated that the architecture and shape of toner cartridge 100 illustrated in FIGS. 2-5 is merely intended to serve as an example. Those skilled in the art understand that toner cartridges, and other toner containers, may take many different shapes and configurations. Those skilled in the art will also appreciate that positional relationships described herein (e.g., above, below, top, bottom, etc.) refer to operative positions of the image forming device and its components.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner container, comprising:

a housing including a main body that has a reservoir for storing toner;

a wall of the main body includes an inner surface that forms a boundary of the reservoir, the wall of the main body includes an opening therethrough; and a seal having a first face and a second face opposite the first face, the first face of the seal is adhered to a surface of the housing that faces toward an outer surface of the wall of the main body, the second face of the seal is pressed against a portion of the outer surface of the wall of the main body surrounding the opening, the second face of the seal covers the opening to block toner from escaping the reservoir through the opening, wherein the surface of the housing that faces toward the outer surface of the wall of the main body includes an inner surface of a gear plate of the housing, the gear plate includes an outer surface that rotatably supports a gear of the toner container.

2. The toner container of claim 1, wherein the seal includes an alignment feature formed along an edge of the seal mated with a corresponding alignment feature on the surface of the housing that faces toward the outer surface of the wall of the main body aligning the seal to the housing.

3. The toner container of claim 1, wherein the wall of the main body includes an end wall of the main body forming a longitudinal end of the reservoir.

4. The toner container of claim 1, further comprising a rotatable component positioned in the reservoir having a rotatable shaft, one end of the rotatable shaft is supported by a bearing on the wall of the main body, wherein the opening through the wall of the main body is positioned at a location of the bearing.

5. The toner container of claim 1, further comprising a ring protruding from the outer surface of the wall of the main body surrounding the opening, wherein the second face of the seal is pressed against the ring.

* * * * *